US006691358B1

(12) United States Patent
Engström et al.

(10) Patent No.: US 6,691,358 B1
(45) Date of Patent: Feb. 17, 2004

(54) OXIDIZED WHITE LIQUOR IN AN OXYGEN DELIGNIFICATION PROCESS

(75) Inventors: Anders Tor Jörgen Engström, Knivsta (SE); Anna Tigerström, Stockholm (SE)

(73) Assignee: AGA Aktiebolag, Lidingo (SE)

( * ) Notice: Subject to any disclaimer, the term of this patent is extended or adjusted under 35 U.S.C. 154(b) by 0 days.

(21) Appl. No.: 10/088,180

(22) PCT Filed: Sep. 18, 2000

(86) PCT No.: PCT/SE00/01803

§ 371 (c)(1),
(2), (4) Date: Mar. 15, 2002

(87) PCT Pub. No.: WO01/20075

PCT Pub. Date: Mar. 22, 2001

(30) Foreign Application Priority Data

Sep. 16, 1999 (SE) ..... 9903321-9

(51) Int. Cl.[7] ..... D21C 11/04; D21C 7/00; D21C 7/06; D06M 11/00

(52) U.S. Cl. ..... 008/116.1; 008/115.69; 008/128.3; 008/129; 162/29; 162/30.11; 423/551; 252/186.1

(58) Field of Search ..... 252/186.1, 186.28; 162/30.11, 29; 423/991; 008/116.1, 128.3, 129, 115.69

(56) References Cited

U.S. PATENT DOCUMENTS 3,964,962 A * 6/1976 Carlsmith ..... 162/236
5,352,332 A 10/1994 Maples et al.
5,500,085 A * 3/1996 Magnotta et al. ..... 162/30.11

FOREIGN PATENT DOCUMENTS

EP 0 543 135 A1 5/1993
EP 0 792 395 B1 5/1999
WO WO 94/01606 1/1994
WO WO 98/23810 6/1998

OTHER PUBLICATIONS

Edited by R.P. Singh, "The Bleaching of Pulp ", pp. 186, 187, 197–201, Tappi Press, third edition revised.
Tappi symposium notes, "Evaluation of Oxidized White Liquor as an Alkali Source", 1990, pp. 153–161.
Ahlstrom Machinery Processes, "White Liquor Oxidation", 1997, pp. 117–119.
Brief summary indicating prior use.

* cited by examiner

*Primary Examiner*—Yogendra N. Gupta
*Assistant Examiner*—Kallambella M Vijayakumar
(74) *Attorney, Agent, or Firm*—Pearne & Gordon LLP

(57) ABSTRACT

The invention refers to a method for an integrated treatment of cellulose pulp. The method includes the steps: providing said cellulose pulp (1), providing a determined quantity of white liquor (2) including alkali and sulphur components, providing an oxygen-containing gas, oxidizing (5) the sulphur components of the white liquor by the supply of a part of said gas in such a way that at least a part of the sulphur is present in the form of sulphate, transporting the cellulose pulp having a certain kappa number to at least one mixing device (4), and supplying the oxidized white liquor from the oxidizing step to the cellulose pulp, supplying a part of said gas to the cellulose pulp in said mixing device, mixing the cellulose pulp with the oxidized white liquor and said gas in said mixing device, and transporting the cellulose pulp from said mixing device to a delignification reactor (6) for oxygen delignification of said cellulose pulp, wherein the kappa number is reduced.

27 Claims, 1 Drawing Sheet

OXIDIZED WHITE LIQUOR IN AN OXYGEN DELIGNIFICATION PROCESS

This application claims the benefit of International Application Number PCT/SE00/01803, which was published in English on Mar. 22, 2001.

THE BACKGROUND OF THE INVENTION AND PRIOR ART

The present invention refers to a method for an integrated treatment of cellulose pulp, including providing said cellulose pulp, providing a determined quantity of white liquor including alkali and sulphur components and providing an oxygen-containing gas. More precisely, the invention refers to the production of pulp and is especially directed to the so called oxygen delignification stage.

In sulphate pulp production intended for the manufacture of bleached/white cellulose pulp for white products, such as printing paper, white cardboard, hygienic products, the aim of the process is to remove as much lignin as possible. The largest quantity is dissolved already during the pulping where the wood chips are pulped in white liquor. In the white liquor both hydroxide ions (=alkali), for instance from NaOH, and hydrogen sulphide ions and their derivates are active components. The white liquor is manufactured in situ and consumed liquor is recovered after having passed the chemical recovering cycle.

Thereafter, the pulped cellulose pulp is most frequently supplied to an oxygen delignification stage, where alkali and oxygen are added. Today, this conventionally takes place at a pulp consistency of 10–12%. As alkali source white liquor, which is an internally generated alkali, is most frequently utilised. However, since it is experienced, in connection with the introduction of the oxygen delignification technique in the 1970's, that untreated white liquor resulted in negative effects to the quality of the pulp, the white liquor is today oxidised in such a way that the sulphide is converted to thio-sulphate. The oxidising may be performed by means of air or pure oxygen gas. The filtrate of the oxygen delignification stage is normally also recycled to the chemical recovering cycle.

After the oxygen delignification the cellulose pulp is bleached in order to remove the last residues of lignin and thus a light and pure pulp is obtained. In conventional bleaching, chlorine dioxide and peroxide are included, but also completely chlorine-free alternatives with ozone or peracetic acid are used commercially today. Old, but still used bleaching agents, are chlorine and hypochlorite. The negative effects of the bleaching filtrates, if they are released, has resulted in, partly, a reduction of the bleaching need, partly a specific reduction of the chlorine chemical use and partly attempts to recycle or recover the bleaching filtrates. One way of reducing the bleaching need is to perform more delignification work in the oxygen delignification stage.

However, there are an upper limit for how much oxygen gas which may be supplied to the delignification stage and this restricts the possibilities to increase the delignification work, since it is not possible to mix too large gas quantities into the mixing devices which are available today. If one increases the gas quantity or gas volume above determined limits channels are formed in the pulp and at least a part of the supplied and expensive oxygen gas will pass through the pulp without effecting any delignification work. One way of solving this problem is to utilise more than one mixing device, which of course involves higher costs.

EP-A-543 135 describes a method for producing oxidised white liquor and totally oxidised white liquor. In this patent application different tries are described, in which oxidised white liquor is utilised as an alkali source in different process steps during the pulp production. EP-A-543 135 includes a brief statement that fully oxidised white liquor may be preferred over partially oxidised liquor for the oxygen delignification of pulps from certain types of woods without giving any teaching as how to such delignification is to be performed or to which types of woods such a delignification would be applicable.

EP-A-792 395 describes a method for regenerating the rest gas from an ozone bleaching stage and utilise this rest gas in the oxygen delignification.

SUMMARY OF THE INVENTION

The object of the present invention is to improve the efficiency of the oxygen delignification.

This object is obtained by a method for an integrated treatment of cellulose pulp, including at least the following steps of:

- providing said cellulose pulp;
- providing a determined white liquor including alkali and sulphur components;
- providing an oxygen-containing gas;
- oxidising the sulphur components of the white liquor by the supply of a part of said gas in such a way that at least a substantial part of the sulphur is present in the form of sulphate;
- transporting the cellulose pulp having a certain kappa number to at least one mixing device;
- supplying oxidised white liquor from said oxidising step to the cellulose pulp;
- supplying a part of said gas to the cellulose pulp in said mixing device;
- mixing of the cellulose pulp with the oxidised white liquor and said gas in said mixing device and
- transporting the cellulose pulp from said mixing device to a delignification reactor for oxygen delignification of the cellulose pulp, wherein the kappa number is reduced.

By utilising oxidised white liquor including sulphate in the oxygen delignification stage instead of partially oxidised white liquor including thio-sulphate a plurality of advantages are obtained. In such a way one may avoid that a part of the oxygen supplied to be oxygen delignification reactor is used to oxidise the sulphur components (mainly thio-sulphate) and instead is utilised to increase the delignification work. This involves only a displacement of the addition of oxygen. No additional oxygen is consumed for the oxidation of the sulphur components when this now is done in the preceding oxidising of the white liquor, i.e. outside the delignification reactor. The method according to the invention enables the achievement of many advantages. For instance, it is possible, if one starts with a relatively high lignin content in the pulp into the oxygen delignification stage to increase the wood yield, which involves direct economical advantages and indirect advantages since the capacity in the pulper increases and the load on the chemical recovery decreases. If one decreases the lignin content from the delignification stage the successive bleaching need is reduced, which is advantageous both from an environmental and economical point of view.

A further advantage is that the heat from the exothermic oxidation of the sulphur components is developed outside the oxygen delignification reactor. This enables a better control of the temperature within the delignification reactor during the delignification. Consequently, the cellulose pulp may, according to an embodiment of the invention, be heated before it is supplied to the delignification reactor for maintaining a determined and substantially uniform temperature level during the delignification. The temperature of the totally oxidised white liquor, when it is mixed into the pulp, may thus be chosen with regard to an optimal delignification. Preferably, said temperature level is between 70° C. and 120° C., for instance 85° C. and 100° C. Advantageously, the temperature of the oxidised white liquor is measured and the oxidised white liquor, which is supplied to the cellulose pulp, is cooled in response to this measurement. In such a way, the heat formed during the oxidising of the sulphur components may be absorbed and utilised for preheating the cellulose pulp. It is also to be noted that the method according to the invention also enables the achievement of a uniform temperature distribution in the delignification reactor, i.e. one may avoid local temperature peaks in the cellulose pulp, which previously could include local temperature increases of 70° C. and thus have a negative influence on the selectivity.

According to a further embodiment of the invention, the method includes controlling the quantity of oxidised liquor supplied to the cellulose pulp in such a way that a desired, determined alkali content profile is maintained during the deliginiflcation step. When, according to the prior art, the oxidation of the sulphur components takes place within the oxygen delignification reactor, the alkali content has to be extra high initially in order to compensate for the alkali consumption of the sulphur oxidation. A too high alkali content is negative to the selectivity since it does not only result in removal of lignin but also in a decomposition of cellulose fibres. By oxidising the sulphur components outside the delignification reactor a greater freedom in the design of the alkali content profile (i.e. the alkali content in the pulp as a function of the time) in the delignification step so that a desired selectivity may be maintained and thus the quality of the pulp produced may be raised. Consequently no increased quantity of alkali is consumed in order to achieve the same delignification result as according to the prior art. Possibly, the total alkali need may be reduced since one may avoid the alkali consuming cellulose/hemicellulose reactions in the delignification step. Advantageously, a parameter, which is related to the content of alkali of the cellulose pulp, for instance the pH-value, is measured at at least one position in the delignification step, wherein said control is performed in response to said measurement.

According to a further embodiment of the invention, the delignified cellulose pulp is supplied to a bleaching process. Reducing as well as oxidising bleaching is possible. For instance, the pulp may be bleached by ozone, peroxide, chlorine dioxide, peracetic acid etc. Advantageously, the bleaching process includes peroxide and/or peroxide/oxygen bleaching steps, wherein oxidised white liquor from said oxidising step is supplied to the cellulose pulp in the bleaching process. According to the prior art, pure NaOH is normally employed as alkali during the peroxide bleaching. By replacing NaOH by oxidised white liquor, the need of externally added alkali may be reduced.

According to a further embodiment of the invention, the cellulose pulp has a pulp consistency which is at least 5% and at most 20%, preferably at least 8% and at most 15% and especially at least 10% and at most 12%, for instance 11%. The cellulose pulp may include chemical pulps produced in digesting processes such as for instance sulphate pulping, sulphate pulping, sulphite pulping with polysulphide, ASAM, MILOX.

According to a further embodiment of the invention said oxygen-containing gas may include at least 60%, at least 70%, at least 80% or at least 90% oxygen. Due to the higher efficiency in the oxygen delignification it is thus possible to utilise less pure oxygen than previously. Of course the best result is obtained by a substantially pure oxygen, which in a commercial context may include about 90–95% or 99–100% oxygen. Very good results also ought to be obtained by a gas which includes 86–88% oxygen.

According to a further embodiment of the invention, said part of the oxygen-containing gas supplied to the mixing device includes a determined quantity of $O_2$ in relation to the reduction of the kappa number and ton of pulp. Thereby, said determined quantity is at the most 1, 7 kg, preferably at the most 1, 5 kg, more preferably at the most 1, 3 kg, and most preferably at the most 1, 2 kg $O_2$ per reduced kappa number and ton of pulp.

According to a further embodiment of the invention the pulp substantially consists of softwood pulp. According to another embodiment, the pulp substantially consists of hardwood pulp.

According to a further embodiment of the invention, the kappa number, during said oxygen delignification step, is reduced by at least 50%, at least 55%, at least 60%, at least 65%, at least 70%, or most specifically at least 75%.

BRIEF DESCRIPTION OF THE DRAWING

The present invention is now to be explained more closely by a description of an embodiment and with reference to the drawing attached in which FIG. 1 discloses schematically a block diagram over a method for an integrated treatment of cellulose pulp.

DETAILED DESCRIPTION OF AN EMBODIMENT OF THE INVENTION

Figure 1:
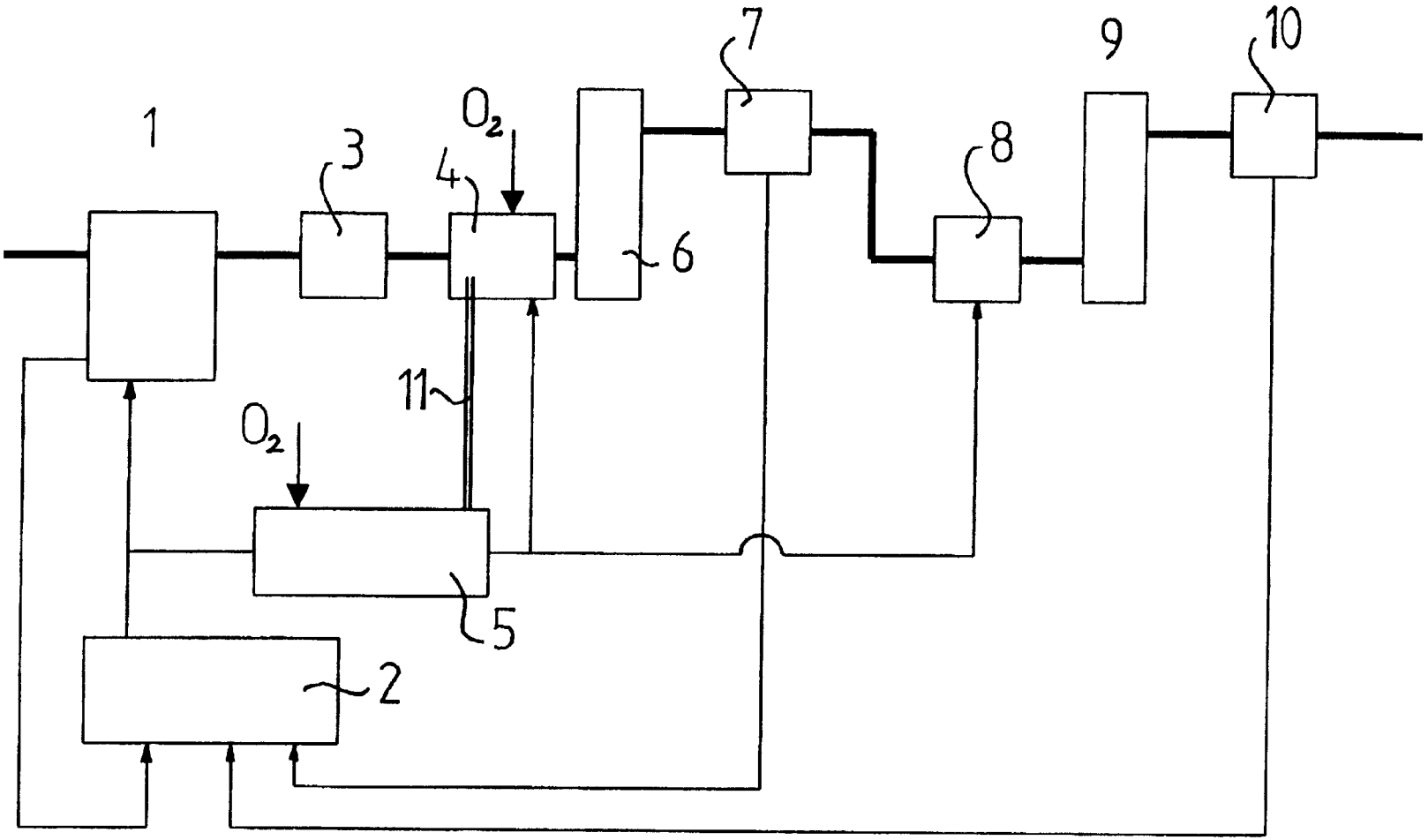

FIG. 1 discloses schematically a method for an integrated treatment of cellulose pulp. Wood chips are supplied to a pulper 1 for producing a cellulose pulp and more particularly a sulphate pulp. The pulper 1 is supplied with white liquor from an integrated white liquor manufacture 2, the so called chemical recovering cycle. Used white liquor is recycled from the pulper 1 to the white liquor manufacture 2 in a manner known per se. From the pulper 1 the produced cellulose pulp is transported to the washing 3, which as such may include one or several washing stages. From the washing 3 the cellulose pulp is transported to a mixing device 4. FIG. 1 discloses one mixing device but the method may include two or several mixing devices provided after each other for the addition of chemicals. In the mixing device 4 the washed cellulose pulp is mixed with alkali in the form of oxidised white liquor, i.e. white liquor in which a substantial part of all or substantially all sulphur components have been oxidised to sulphate. In the description it is referred to totally oxidised liquor in the following even if not all sulphur components necessarily have been oxidised to sulphate.

The totally oxidised white liquor is manufactured in an integrated oxidising device 5, which receives none or partly oxidised white liquor from the white liquor manufacture 2. The oxidising device 5 is supplied with an oxygen-containing gas, for instance air or a gas which includes for instance at least 60%, at least 70%, at least 80% or at least 90% oxygen, for instance 86–88% oxygen, 90–95% oxygen or 99–100% oxygen.

The mixing device 4 may be provided in a substantially direct connection to the oxygen delignification step 6 and the cellulose pulp is thus supplied to the oxygen delignification step 6 after the mixing device 4. The oxygen-containing gas required in the oxygen delignification step 6 is supplied to the mixing device 4 for the achievement of a uniform distribution of oxygen in the cellulose pulp. The oxygen-containing gas supplied to the mixing device 4 may include at least 60%, at least 70%, at least 80% or at least 90% oxygen, for instance 86–88% oxygen, 90–95% oxygen or 99–100% oxygen. The cellulose pulp has in the oxygen delignification step a consistency of between 5–20%, preferably 8–15% and especially 10–12%. The oxygen delignification step 6 is performed in one or several oxygen delignification reactors, possibly with intermediate washing, pumps and mixing devices where heat or chemicals, such as oxygen or alkali, are added. The total residence time for the pulp in the whole oxygen delignification step 6 is at least 10 minutes, at least 20 minutes or at least 30 minutes. The delignified cellulose pulp is then transported to a washing 7, including one or several washing steps, and from there to a further mixing device 8 before the cellulose pulp is supplied to a bleaching step 9. The filtrate from the washing 7 is recycled directly or indirectly to the white liquor manufacture 2. In the mixing device 8 the desired bleaching chemicals, for instance peroxide, chlorine dioxide, peracetic acid, ozone etc., are added. After the bleaching step 9, the pulp is supplied to a further washing 10. The filtrate from the washing 10 may depending on the used bleaching chemicals be recycled directly or indirectly to the white liquor manufacture 2. Advantageously, the bleaching step includes peroxide and/or peroxide/oxygen bleaching. Thereby, totally oxidised white liquor may be supplied as alkali from the oxidising device 5. A totally oxidised white liquor is suitable supplied to the mixing device 8 in a corresponding manner as in the oxygen delignification. The quantity of externally added sodium hydroxide may thereby be reduced or completely dispensed with regard to the bleaching, wherein the integration extent of the method increases. Also the bleaching step 9 may include one or several bleaching reactors with intermediate washing steps and mixing devices.

In the oxidising device 5 a two step oxidising of the sulphate present in the white liquor is performed. In a first reaction, sulphide is oxidised to thio-sulphate and in a second reaction thio-sulphate is oxidised to sulphate. It is also possible to utilise partly oxidised white liquor having mainly thio-sulphate as an starting sulphur component. The oxidation is operated so far that substantially all sulphur components in the white liquor are present in the form of sulphate. The two oxidation reactions are both exothermic, i.e. heat is developed in the oxidising device 5. This heat may be utilised, partly, to give the totally oxidised white liquor a suitable temperature when it is supplied to the mixing device 4, and partly to heat the cellulose pulp which is supplied to the oxygen delignification step 6. Such a heating may be performed by means of a schematically indicated heat exchanger device 11. The heat exchanger device 11 may be designed to supply steam to the cellulose pulp in the mixing device 4 so that the cellulose pulp is given a temperature of between 70° C. and 120° C., for instance 85° C. and 100° C. in the oxygen delignification step. The method according to the invention may enable a higher temperature and thus a quicker delignification. For instance, the temperature in the oxygen delignification may be at least 100° C. or at least 110° C. According to the invention it is thus easier to keep a uniform temperature during the oxygen delignification step 6 since the exothermic sulphur oxidising reactions now take place outside the delignification reactors. Consequently, we will not have any temperature increase due to oxidation of sulphur components in the oxygen delignification step 6. Advantageously, the temperature after the oxidation process in the oxidising device 5 is measured and the heat exchange is controlled in response to said measurement in such a way that the desired temperature mentioned above may be maintained. It is also possible to supply the oxygen-containing gas to the oxygen delignification step 5 via the steam supplied to the mixing device 4.

The method according to the invention enables with respect to the delignification and selectivity obtained an improved control of the alkali content profile, i.e. the alkali content as a function of the time in the cellulose pulp in the oxygen delignification step. By the method according to the invention an equalised alkali content profile is obtained in comparison with the prior art, i.e. in order to obtain a determined alkali content after the oxygen delignification, the initial alkali content may be reduced in relation to a corresponding oxygen delignification with the addition of partly oxidised white liquor. Such a equalised alkali content profile is possible since no substantial alkali consuming bi-reaction in the form of oxidation of sulphur components will take place in the oxygen delignification reactor, but the main alkali consumption will take place in the reactions with the cellulose pulp. Thus, the quantity of totally oxidised white liquor which is supplied to the cellulose pulp in the mixing device 4 may be chosen in such a way that a desired initial alkali content is obtained in the oxygen delignification reactor. Such a control may be done by measuring for instance the pH-value in the oxygen delignification reactor, for instance at the outlet end of the oxygen delignification step 6, and by controlling the quantity of supplied totally oxidised white liquor in response to this value. According to estimates made by the applicant, the amount of alkali supplied to the pulp before the oxygen delignification stage may be 10–20% lower and at least 5–10% lower with totally oxidised white liquor in comparison with none totally oxidised white liquor for the achievement of the same delignification result. If one instead chooses to maintain the same quantity of alkali when totally oxidised white liquor is supplied as when none totally oxidised white liquor is used, a more far-reaching delignification of the cellulose pulp is obtained. From the table below, there appear as examples the addition of chemicals before the oxygen delignification step, the resulting quantity of removed lignin measured as delta kappa, and the consumption of chemicals per removed kappa number for different quantities of partially oxidised white liquor (OWL) and totally oxidised white liquor (TOWL).

TABLE

| kg NaOH/ton | Kg O2/ton | Delta kappa | kg NaOH/kappa | kg O2/kappa |
|---|---|---|---|---|
| (OWL) 36 | 18 | 18 | 2* | 1* |
| (TOWL) 29 | 12 | 18 | 1.6 | 0.7 |
| (TOWL) 36 | 16 | 22.5 | 1.6 | 0.7 |
| (TOWL) 41 | 18 | 25.7 | 1.6 | 0.7 |

*The total need of chemicals in the step for delignifying and oxidising the suplhur components divided with the quantity of released lignin measured as delta kappa.

The method according to the invention may be performed with for instance the following quantities of oxygen to the oxygen delignification reactor in relation to the reduction of the kappa number and ton of pulp for softwood pulp and hardwood pulp.

Softwood Pulp

For such pulp, the determined quantity of oxygen in the oxygen-containing gas supplied to the pulp in the mixing device 4 substantially immediately upstream of the oxygen delignification step 6 may be at the most 1, 5 kg $O_2$ per reduced kappa number ($\Delta\kappa$) and ton of pulp. Thereby, the delignification result, i.e. the reduction of the kappa number in percent, may be at least 45%, 50%, 55%, 60%, 65%, 70% or 75%, depending on for instance the generally quality of the pulp, such as cleanliness, initial kappa number, consistency, homogeneity, and external factors such as the design og the fibre line. These delignification results may also be obtained with a smaller quantity if oxygen, for instance, at the most 1, 4 kg, 1, 3 kg, or even only 1, 2 kg $O_2$ per reduced kappa number ($\Delta\kappa$) and ton of pulp. Generally, said determined quantity of oxygen per kappa number and ton of pulp is increasing with an increase of the desired delignification result.

In other words, said determined quantity of oxygen Q to be supplied to the oxygen delignifiaction step 6 via the mixing device 4 may be expressed by the following formula:

$$Q=d+b,$$

where

Q=kg $O_2$/reduced kappa number and ton of pulp d=the delignification result in percent/100 b=a number between 0.60 and 0.75, e.g. 0.65 or 0.70

Hardwood Pulp

In a corresponding manner, the determined quantity of oxygen in the oxygen-containing gas supplied to hardwood pulp in the mixing device 4 substantially immediately upstream of the oxygen delignification step 6 may be somewhat higher than for softwood pulp and, for instance, at the most 1, 7 kg $O_2$ per reduced kappa number ($\Delta\kappa$) and ton of pulp. Thereby, the delignifica-rion result, i.e. the reduction of the kappa number in percent, may be at least 40%, 50%, 60% or 70%, depending on for instance the quality of the pulp. These delignification results may also be obtained with a smaller quantity of oxygen, for instance, at the most 1, 6 kg, 1, 5 kg, or even only 1, 4 kg $O_2$ per reduced kappa number ($\Delta\kappa$) and ton of pulp. The above-identified formula is applicable also to hardwood pulp, wherein b=a number between 0.80 and 0.95, e.g. 0.85 or 0.90.

The invention is not limited to the embodiment described but may varied and modified within the scope the following claims. The method is not only applicable to sulphate pulp but also to other chemical pulps, such as for instance sulphite pulp, wherein the white liquor is provided externally, for instance from an adjacent sulphate pulp production.

What is claimed is:

1. A method for an integrated treatment of chemical cellulose pulp, including at least the following steps of:

providing said cellulose pulp, said pulp substantially consisting of softwood pulp;

providing a determined white liquor including alkali and sulphur components;

providing an oxygen-containing gas;

oxidising the sulphur components of the white liquor by the supply of a part of said gas in such a way that substantially all sulphur components are present in the form of sulphate;

transporting the cellulose pulp having a certain kappa number to at least one mixing device;

supplying oxidised white liquor from said oxidising step to the cellulose pulp;

supplying a part of said gas to the cellulose pulp in said mixing device;

mixing of the cellulose pulp with the oxidised white liquor and said gas in said mixing device and transporting the cellulose pulp from said mixing device to a delignification reactor for oxygen delignification of the cellulose pulp, wherein the kappa number is reduced by at least 45%, wherein said part of the oxygen-containing gas supplied to the mixing device includes a determined quantity of $O_2$ in relation to the reduction of the kappa number and weight of pulp, said determined quantity being at most 1.3 kg $O_2$ per reduced kappa number and ton of pulp.

2. A method according to claim 1, wherein the cellulose pulp is heated before it is supplied to the delignification reactor for maintaining a determined and substantially uniform temperature level during the oxygen delignification.

3. A method according to claim 2, wherein said temperature level is between 70° C. and 120° C., for instance 85° C. and 100° C.

4. A method according to claim 2, including measuring the temperature of the oxidised white liquor and cooling of the oxidised white liquor supplied to the cellulose pulp in response to said measurement.

5. A method according to claim 1, including absorbing the heat formed during said oxidising of the sulphur components.

6. A method according to claim 5, including supplying the absorbed heat to the delignification step for said preheating of the cellulose pulp.

7. A method according to claim 1, including controlling the quantity of the oxidised white liquor supplied to the cellulose pulp in such a way that a desired alkali content profile is maintained during the delignification step.

8. A method according to claim 7, further comprising the step of measuring a parameter related to the content of alkali in the cellulose pulp at at least one position in the delignification step, said controlling being performed in response to said measurement.

9. A method according to claim 1, including the successive step of:

supplying the delignified cellulose pulp to a bleaching process.

10. A method according to claim 9, wherein the bleaching process includes peroxide and/or peroxide/oxygen bleaching and wherein the oxidised white liquor from said oxidizing step is supplied to the cellulose pulp in the bleaching process.

11. A method according to claim 1, wherein the cellulose pulp has a pulp consistency which is at least 5%, preferably at least 8% and particularly at least 10%.

12. A method according to claim 1, wherein the cellulose pulp has a pulp consistency which is at the most 20%, preferably at the most 15% and particularly at the most 12%.

13. A method according to claim 1, wherein the cellulose pulp includes a chemical pulp, produced in a digesting processes selected from the group consisting of sulphate pulping, sulphite pulping, sulphate pulping with polysulphide, ASAM, MILOX.

14. A method according to claim 1, wherein said first and/or second oxygen-containing gas includes at least 60%, at least 70%, at least 80% or at least 90% oxygen.

15. A method according to claim 1, wherein said determined quantity is at the most 1.5 kg $O_2$ per reduced kappa number and ton of pulp.

16. A method according to claim 1, wherein said determined quantity is at the most 1.2 kg $O_2$ per reduced kappa number and ton of pulp.

17. A method according to claim 1, wherein the kappa number during said oxygen delignification step is reduced by at least 50%.

18. A method according to claim 1, wherein the kappa number during said oxygen delignification step is reduced by at least 55%.

19. A method according to claim 1, wherein the kappa number during said oxygen delignification step is reduced by at least 60%.

20. A method according to claim 1, wherein the kappa number during said oxygen delignification step is reduced by at least 65%.

21. A method according to claim 1, wherein the kappa number during said oxygen delignification step is reduced by at least 70%.

22. A method according to claim 1, wherein the kappa number during said oxygen delignification step is reduced by at least 75%.

23. A method according to claim 1, wherein said determined quantity of oxygen is calculated by the formula:

$$Q=d+b,$$

where

Q=kg $O_2$/reduced kappa number and ton of pulp d=the delignification result in percent/100 b=a number between 0.60, 0.65, 0.70, 0.75, 0.80, 0.85, 0.90 or 0.75.

24. A method for an integrated treatment of chemical cellulose pulp, including at least the following steps of:

providing said cellulose pulp, said pulp substantially consisting of hardwood pulp;

providing a determined white liquor including alkali and sulphur components;

providing an oxygen-containing gas;

oxidising the sulphur components of the white liquor by the supply of a part of said gas in such a way that substantially all sulphur components are present in the form of sulphate;

transporting the cellulose pulp having a certain kappa number to at least one mixing device;

supplying oxidised white liquor from said oxidising step to the cellulose pulp;

supplying a part of said gas to the cellulose pulp in said mixing device;

mixing of the cellulose pulp with the oxidised white liquor and said gas in said mixing device and transporting the cellulose pulp from said mixing device to a delignification reactor for oxygen delignification of the cellulose pulp, wherein the kappa number is reduced by at least 45%, wherein said part of the oxygen-containing gas supplied to the mixing device includes a determined quantity of $O_2$ in relation to the reduction of the kappa number and weight of pulp, said determined quantity being at most 1.7 kg $O_2$ per reduced kappa number and ton of pulp.

25. A method according to claim 24, wherein said determined quantity is at the most 1.5 kg $O_2$ per reduced kappa number and ton of pulp.

26. A method according to claim 24, wherein said determined quantity is at the most 1.3 kg $O_2$ per reduced kappa number and ton of pulp.

27. A method according to claim 24, wherein said determined quantity is at the most 1.2 kg $O_2$ per reduced kappa number and ton of pulp.

* * * * *